US005357070A

United States Patent [19]

Parsons, Jr.

[11] Patent Number: 5,357,070

[45] Date of Patent: Oct. 18, 1994

[54] SLIDE SWITCH ON-OFF INDICATOR AND LOCK APPARATUS

[76] Inventor: William H. Parsons, Jr., 10074 Devenshire Dr., Baton Rouge, La. 70809

[21] Appl. No.: 96,252

[22] Filed: Jul. 26, 1993

[51] Int. Cl.[5] ..... H01H 3/20

[52] U.S. Cl. ..... 200/331; 200/43.04; 200/43.11; 200/308

[58] Field of Search ..... 200/43.01, 43.04, 43.11, 200/43.16, 330, 331, 333, 338, 308

[56] References Cited

U.S. PATENT DOCUMENTS

| | | | |
|---|---|---|---|
| 2,285,561 | 6/1942 | Botuck | 200/330 |
| 2,807,692 | 9/1957 | Leslie | 200/333 |
| 3,974,346 | 8/1976 | Keprda | 200/5 B |
| 4,105,884 | 8/1978 | Damsky | 200/331 |
| 4,435,624 | 3/1984 | Sepulveda | 200/334 |
| 4,872,099 | 10/1989 | Kelley et al. | 200/330 X |
| 4,873,403 | 10/1989 | Counts et al. | 200/330 |
| 4,973,801 | 11/1990 | Frick et al. | 200/43.19 |
| 5,219,070 | 6/1993 | Grunert et al. | 200/43.11 X |

FOREIGN PATENT DOCUMENTS

| | | | |
|---|---|---|---|
| 729677 | 4/1980 | U.S.S.R. | 200/331 |
| 1177347 | 1/1970 | United Kingdom | 200/331 |

*Primary Examiner*—Glenn T. Barrett
*Attorney, Agent, or Firm*—Robert Montgomery

[57] ABSTRACT

The present invention provides a means for locking "off" or locking "on" an electrical slide switch. The shape definition of the invention further serves as a position indicator, whereby even a casual glance confirms the position of the switch, even from some distance.

20 Claims, 1 Drawing Sheet

SLIDE SWITCH ON-OFF INDICATOR AND LOCK APPARATUS

BACKGROUND OF THE INVENTION

1. Field of the Invention

This invention relates to a lock-off-lock-on position indicator which further prevents the inadvertent operation of an electrical slide switch. The invention further provides for the positioning of the slide switch to either the "on" or "off" position as a result of the direction the indicator is turned.

2. General Background

Slide switches are generally mounted within certain electrical devices as circuit interrupters. These switches are usually mounted so that the actuating handle extends outwardly and slightly above a slot in the enclosure. The enclosure slot is positioned so that the switch handle can be traversed to a (first) on-position and a (second) off-position. However, in some cases the switch is mounted well below the surface of the enclosure; in such cases an additional, slidable handle is provided. The handle is usually configured with a low profile extending downward through a slot in the enclosure to encompass the switch handle. To prevent the accidental actuation of the switch, a ridge formed on the enclosure slightly lower than the switch handle is sometimes used to surround the enclosure slot. When slide switches are located in a parallel relationship, they are often seperated by a raised barrier to prevent accidental activation of the wrong switch. Slide switches are generally small and usually operated by pushing or pulling the switch handle with a finger on the top of the handle. This makes the position of the switch hard to see from a distance. Slide switches are often overlooked due to their size and the fact that they are often recessed.

Very little has been done to correct the problems associated with such slide switches discussed above. However, one method of locking a slide switch was disclosed by Frick et al. in U.S. Pat. No. 4,973,801. The locking device in this case allows for locking the slide switch in the full-off position but can only be removed by service personnel. The device is therefore not readily removable or reversible for locking the switch in the "on" position. Keprda in his U.S. Pat. No. 3,974,346 discloses a means of locking several ganged miniature slide switches by lowering a pivotal cover which blocks the movement of the slide switch. Although this design does lock the switches, it does not provide a means of urging the switches into position and does not provide a visual indication of the switches' position from a distance. Keprda certainly does not disclose a means for repositioning the switch simply by changing the direction of the locking means.

SUMMARY OF THE PRESENT INVENTION

The present invention provides a means for locking an electrical slide switch in the on or off position. The shape definition of the invention further serves as a position indicator whereby even a casual glance confirms the position of the switch, even from some distance.

The disclosed actuation handle has both external and internal shapes. The external portion of the handle of the preferred embodiment is elliptical, shaped to fit between the thumb and forefinger and is provided with ridges, providing a positive grip when being inserted or extracted from over the switch's actuating handle. This increased height makes the handle much easier to see and provides a positive grip for removing and repositioning.

The internal shape of the invention further prevents the inadvertent operation of a slide switch when attached thereto and also provides for the positioning of the slide switch to either the "on" or "off" position depending on the direction the invention is turned. To install the present invention, one need only remove the existing slide switch actuator extension and install the present invention in its place by inserting it through the slot in the enclosure and over the switch knob. Arrows are provided at one end of the present invention, indicating the position of the switch when installed. The internal configuration of the present invention is sloped in a manner which urges the switch handle in the direction of the arrow located on the upper portion as the new switch actuator handle is being inserted over the switch. When installed, the lower portion of the new actuator handle fills the slot around the switch handle, thereby blocking the switch handle's retreat. Therefore, to move the switch to its alternate position, the new switch actuator must be withdrawn and reinserted in the opposite direction.

It is therefore an object of the present invention to provide a more positive means of moving and locking a slide switch in either the "on" or "off" position.

It is a further object of the present invention to provide a more visual indication of the position of a slide switch.

BRIEF DESCRIPTION OF THE DRAWINGS

Other objects, advantages, and features of this invention, together with its construction and mode of operation, will become more apparent from the following description when read in conjunction with the accompanying drawing in which.

DETAILED DESCRIPTION OF THE PREFERRED EMBODIMENT

Figure 1:
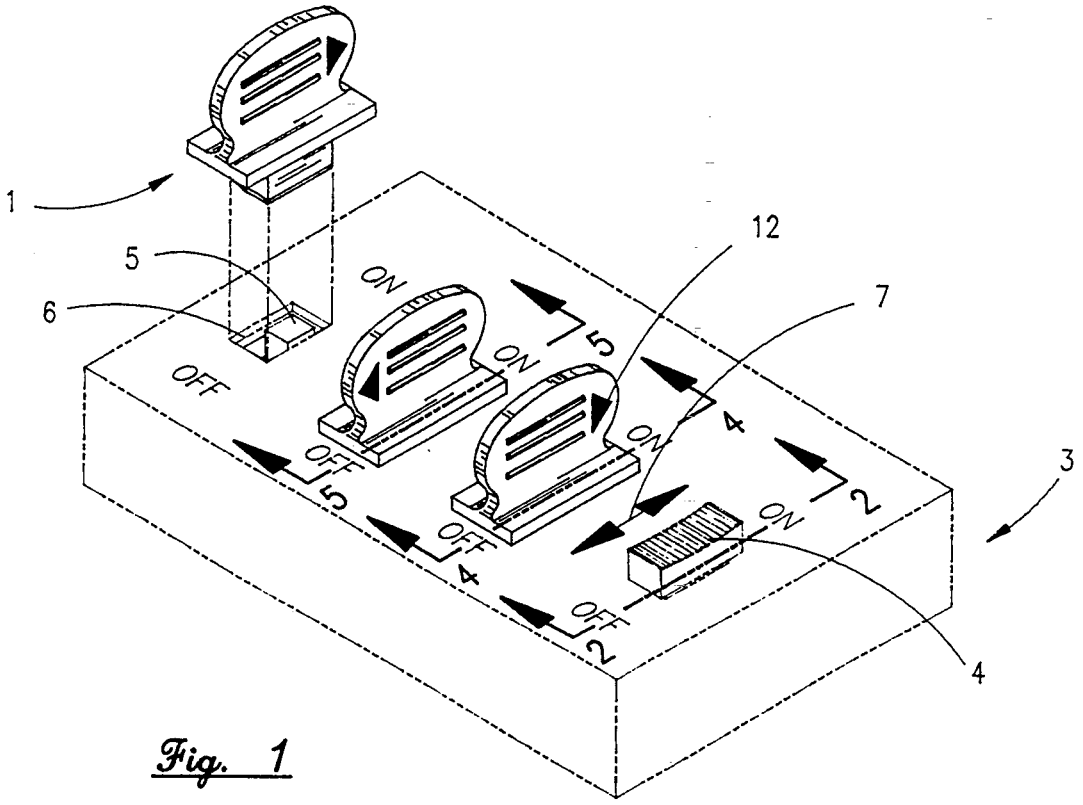
FIG. 1 is an isometric drawing illustrating how the invention would be positioned on an electrical enclosure.
Figure 2:
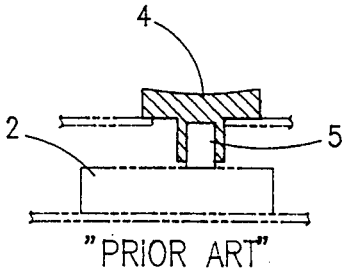
FIG. 2 is a partial cross section view taken along line 2—2 in FIG. 1 of a typical slide switch arrangement.
Figure 3:
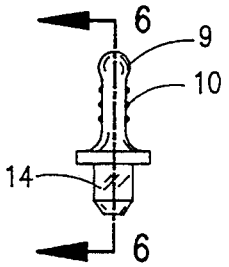
FIG. 3 is an end view of the instant invention.
Figure 4:
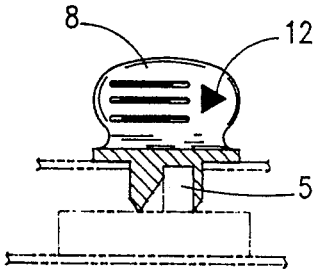
FIG. 4 is a partial cross section view taken along line 4—4 in FIG. 1 of the instant invention positioned in the "ON" direction.
Figure 5:
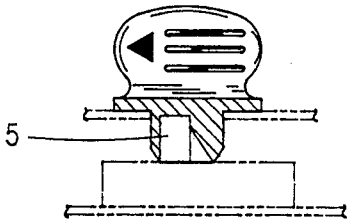
FIG. 5 is a partial cross section view taken along line 5—5 in FIG. 1 of the instant invention positioned in the "OFF" direction.

The slide switch handle extension i as shown in FIG. 1 is configured in a manner which allows the slide switch 2 to be recessed below the surface of the enclosure 3 and, in general, takes the place of such switch handle extensions 4 as shown in FIGS. 1 and 2. Typical slide switch handles 5 protrude through the enclosure 3 or utilize extensions 4 which fit securely over the existing slide switch handle 5 when recessed. A slot 6 is provided in the enclosure 3 to allow for the forward and reverse movement 7 of the handle extension 4. The slide switch handle extension 1 utilizes a high-profile, elliptical disk turned on edge as its upper portion 8 which fits easily between the user's thumb and forefinger. This arrangement allows the user to extract or insert the handle extension 1 from the switch 5 and enclosure 3 as seen in FIG. 1 by simply pulling up on the handle extension 1. As best seen in profile in FIG. 3, the upper portion 8 forms an elliptical disk, is slightly flared at its upper end 9 as a result of its concave sides, and has raised ridges 10 along each of the concave sides which provide a positive means for extraction and insertion of the handle extension 1. The upper portion 9 culminates at the lower edge in a flange 11 which covers the enclosure switch slot 6. As seen in FIGS. 1, 3 & 4, an arrowhead 12 is located at one end and on either side of the upper portion 8 of the switch handle extension 1 indicating which direction the switch handle 5 is placed when the handle extension 1, is in position.

Figure 6:
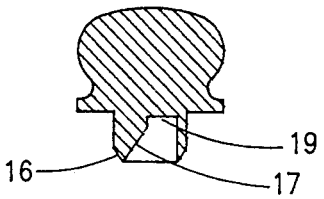
FIG. 6 is a cross section of the instant invention.

The lower rectangular portion having a cavity therein completely fills the switch slot, and 14 extends below the surface of the enclosure 3 and where the cavity is adapted to fit over the existing slide switch handle 5. This handle extension 1 differs from other such handles 4 in that it completely fills the switch slot 6 in the enclosure 3. The handle extension's lower portion 14 is guided into the enclosure slot 6 by a bevel 16 located at the lowermost edge of the lower or base portion 1 as seen in FIGS. 3 & 6. The handle extension 1 further provides an internal socket arrangement which encompasses and guides the existing switch handle 5 into a secure locked on or off position. The on or off of the switch is indicated by the arrow 12 located on the upper portion of the handle extension. This internal configuration as seen in FIG. 6 comprises a socket shape 19 matching that of the existing switch handle 5. However, the socket is offset towards one end of the handle extension 1. This arrangement further provides a bevel 17 for guiding the switch handle 5 in the extension's socket 19. Therefore, by simply pressing down on the handle extension 1, the switch handle 5 is urged towards the socket end 19 by bevel 17. Since the extension 1 completely fills the switch slot 6 in the enclosure 3, the switch 2 is locked in the position indicated by the arrowhead 12 on the upper portion 8 of the handle extension 1. To reposition the slide switch 2, the user simply extracts the handle extension 1, turns it 180 degrees, and reinserts the extension 1, thereby urging the slide switch handle 5 into the opposite position.

Various modifications can be made without departing from the spirit and scope of this invention, it being contemplated that this invention be limited solely by the scope of the allowed claims.

What is claimed is:

1. An electrical slide switch handle extension comprising:

a) an upper portion in the form of an elevated, elliptical shaped, disk;

b) a flange connected to said upper portion and extending perpendicular to said upper portion;

c) a rectangular lower portion, extending below said flange, having a cavity therein adapted to fit an operating handle of a recessed slide switch; and d) a means located in said cavity for urging said slide switch handle to an "on" or "off" position depending on which direction said handle extension is pointing when said switch handle extension engages said switch operating handle.

2. An electrical slide switch handle extension as recited in claim 1, wherein said elevated upper portion has sufficient elevation for grasping between the thumb and forefinger, for extraction from an existing slide switch, recessed in and electrical enclosure, prior to changing the switch's operating position.

3. An electrical slide switch handle extension as recited in claim 1, wherein said elevated upper portion is an elliptical disk turned on edge further comprising concave sides.

4. An electrical slide switch handle extension as recited in claim 3, wherein said elliptical disk further comprises raised ridges along each of said concave sides for providing a better grip on said disk when extracting said slide switch extension handle.

5. An electrical slide switch handle extension as recited in claim 4, wherein said elliptical disk further comprises a direction-indicating means.

6. An electrical slide switch handle extension as recited in claim 5, wherein said direction-indicating means is indicative of the operating position of a slide switch when locked with said handle extension.

7. An electrical slide switch handle extension as recited in claim 1, wherein said lower portion is adapted to fill a slotted opening in an enclosure having a recessed slide switch thereby preventing said handle extension from moving.

8. An electrical slide switch handle extension as recited in claim 7, wherein said means for urging includes a socket that is offset towards one end of said lower portion.

9. An electrical slide switch handle extension as recited in claim 8, wherein said socket has an internal bevel which is adapted to urge the operating handle of a slide switch into either an "on" or "off" position as a result of said handle extension being pressed into place over an existing slide switch handle when said switch is recessed in an enclosure.

10. A lock "off"-lock "on" electrical slide switch handle extension comprising:

a) a raised, elliptical, disk-shaped, upper portion;

b) a flange supporting said elliptical disk adapted for covering a slide switch slot in an enclosure having a recessed slide switch;

c) a lower portion extending below said flange adapted for extending through the switch slot of an enclosure; and d) a socket disposed within said lower portion for engaging and positioning an existing slide switch handle.

11. A lock "off"-lock "on" electrical slide switch handle extension as recited in claim 10, wherein said elliptical disk further comprises a flared upper edge and concave sides.

12. A lock "off"-lock "on" electrical slide switch handle extension as recited in claim 11, wherein said elliptical disk further comprises raised ridges along said concave sides, thereby providing a better finger grip on said disk when extracting said handle extension from an enclosure.

13. A lock "off"-lock "on" electrical slide switch handle extension as recited in claim 12, wherein said elliptical disk further comprises a direction-indicating means.

14. A lock "off"-lock "on" electrical slide switch handle extension as recited in claim 13, wherein said direction-indicating means indicates the position of the slide switch.

15. A lock "off"-lock "on" electrical slide switch handle extension as recited in claim 10, wherein said lower portion is adapted to fit over an existing slide switch handle, thereby filling the slot in an enclosure around said existing switch handle, thus preventing said handle from moving.

16. A lock "off"-lock "on" electrical slide switch handle extension as recited in claim 15, wherein the socket of said lower portion is offset towards one end of said lower portion.

17. A lock "off"-lock "on" electrical slide switch handle extension as recited in claim 15, wherein a portion of said socket has a chamfered side which is adapted to urge the handle of said slide switch into either an "on" or "off" position as a result of said handle extension being pressed into position.

18. A lock "off"-lock "on" electrical slide switch handle extension comprising:

a) a rectangular base portion having depth, a top and bottom;

b) a cavity in the bottom of said base portion having a portion of one wall chamfered adapted for engaging and positioning an operating handle of a slide switch;

c) a flange surrounding the top of said base portion adapted for covering a slot of an enclosure having a recessed slide switch; and d) an elliptical disk turned on edge having concave sides, extending above said flange for extraction and reinsertion of said handle extension each time said slide switch is repositioned.

19. A lock "off"-lock "on" electrical slide switch handle extension as recited in claim 18, wherein said base is beveled for guiding said base into a slide switch slot of an electrical enclosure.

20. A lock "off"-lock "on" electrical slide switch handle extension as recited in claims 1, 10 or 19, wherein said handle extension is capable of being extracted from an existing slide switch handle, rotated 180 degrees and reinserted on said switch.

* * * * *